US009705237B2

(12) United States Patent
Yang et al.

(10) Patent No.: US 9,705,237 B2
(45) Date of Patent: Jul. 11, 2017

(54) ELECTRICAL CONNECTOR WITH EXCELLENT WATERPROOF FUNCTION

(71) Applicant: FOXCONN INTERCONNECT TECHNOLOGY LIMITED, Grand Cayman (KY)

(72) Inventors: Chun-Chieh Yang, New Taipei (TW); Zhi-Hui Zhu, Kunshan (CN); Qin-Xin Cao, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/280,400

(22) Filed: Sep. 29, 2016

(65) Prior Publication Data

US 2017/0093081 A1 Mar. 30, 2017

(30) Foreign Application Priority Data

Sep. 30, 2015 (CN) ..... 2015 1 0634841

(51) Int. Cl.

| | |
|---|---|
| ***H01R 4/60*** | (2006.01) |
| ***H01R 13/52*** | (2006.01) |
| ***H01R 24/58*** | (2011.01) |
| ***H01R 43/00*** | (2006.01) |
| ***H01R 43/20*** | (2006.01) |
| *H01R 107/00* | (2006.01) |

(52) U.S. Cl.

CPC ..... *H01R 13/5202* (2013.01); *H01R 24/58* (2013.01); *H01R 43/005* (2013.01); *H01R 43/20* (2013.01); *H01R 2107/00* (2013.01)

(58) Field of Classification Search

CPC .. H01R 24/58; H01R 2201/12; H01R 13/523; H01R 13/005

USPC ..... 439/669, 668, 909, 191, 190

See application file for complete search history.

(56) References Cited

U.S. PATENT DOCUMENTS

2008/0268703 A1* 10/2008 Chien ..... H01R 24/58 439/541.5

2014/0030911 A1* 1/2014 Nagata ..... H01R 13/5202 439/519

FOREIGN PATENT DOCUMENTS

| | | |
|---|---|---|
| CN | 2667742 | 12/2004 |
| TW | M494420 | 1/2015 |

* cited by examiner

*Primary Examiner* — Phuongchi T Nguyen

(74) *Attorney, Agent, or Firm* — Wei Te Chung; Ming Chieh Chang

(57) ABSTRACT

An electrical connector has a mating cavity opening forwardly. The electrical connector has a main body, a terminal module and a sealing member. The terminal module has an insulator and a plurality of conductive terminals received therein. The conductive terminals have contacting portions exposed into the mating cavity and connecting legs. The terminal module is received in the main body. The sealing member is filled in a gap between the terminal module and main body to seal the gap.

14 Claims, 9 Drawing Sheets

ELECTRICAL CONNECTOR WITH EXCELLENT WATERPROOF FUNCTION

BACKGROUND OF THE INVENTION

1. Field of the Invention

The present invention generally relates to an electrical connector, the electrical connector has excellent waterproof function.

2. Description of Related Art

Chinese patent issued No. 2667742 discloses an audio jack connector. The audio jack connector has an insulating housing and a plurality of conductive terminals retained therein. The insulating housing has a plurality of terminal grooves to receive the aforementioned conductive terminals. The conductive terminals are difficult to be assembled into the insulating housing because of the complex structures. What's more, the audio jack connector does not have waterproof function, which cannot meet the continuous development of the electronic devices.

Therefore, an electrical connector with special waterproof structure is desired hereinafter.

SUMMARY OF THE INVENTION

Accordingly, an object of the present invention is to provide an electrical connector with excellent waterproof function.

In order to achieve the object set forth, an electrical connector has a mating cavity opening forwardly. The electrical connector has a main body, a terminal module and a sealing member. The terminal module has an insulator and a plurality of conductive terminals received therein. The conductive terminals have contacting portions exposed into the mating cavity and connecting legs. The terminal module is received in the main body. The sealing member is filled in a gap between the terminal module and main body to seal the gap.

Other objects, advantages and novel features of the invention will become more apparent from the following detailed description when taken in conjunction with the accompanying drawings.

DETAILED DESCRIPTION OF THE INVENTION

Figure 1:
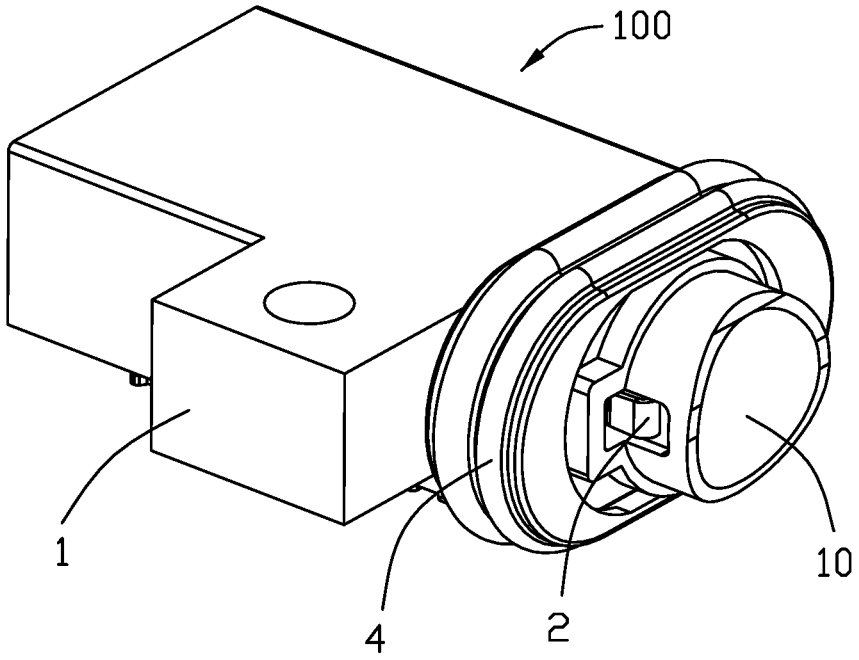
FIG. 1 is a perspective view of an electrical connector of a first embodiment in the present invention.
Figure 2:
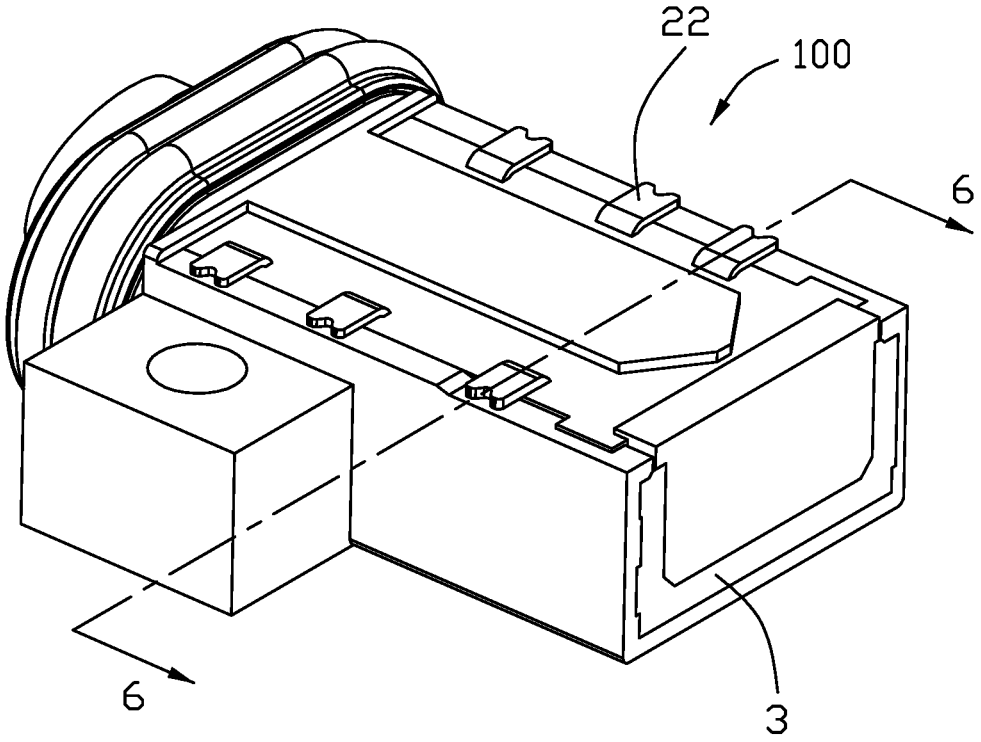
FIG. 2 is another perspective view of the electrical connector shown in FIG. 1.

Reference will now be made in detail to the preferred embodiment of the present invention. Referring to FIG. 1 to FIG. 6, an electrical connector 100 of a first embodiment of the present invention is provided. The electrical connector 100 is functioned but limited as an audio jack connector. Referring to FIG. 1 and FIG. 2, the electrical connector 100 has a mating cavity 10 opening forwardly and comprises an insulating housing 1, a plurality of conductive terminals 2 received in the insulating housing 1, a sealing member 3 and an O-ring member 4 surrounding an outer surface of a front side of the insulating housing 1. The O-ring member 4 is made of waterproof material, such as rubber. The sealing member 3 may be made of sealing material such as epoxy resin, glue and other material having good adhesive and waterproof function. In the present invention, selecting the epoxy resin as the sealing material to support a higher temperature along the process of soldering the conductive terminals 2. The conductive terminals 2 have connecting legs 22 extending out of the insulating housing 1. In general, the sealing material 3 is disposed in a periphery area of the connecting legs 22 to prevent liquid material from outside flowing into an electronic device from gap between the connecting legs 22 and the insulating housing 1.

Referring to FIG. 3 to FIG. 6, the detailed description of preferred embodiment will be described hereinafter. The electrical connector 100 has a main body 11, a terminal module 12 and said sealing member 3. The terminal module 12 is provided with said conductive terminals 2. The conductive terminals 2 have contacting portions 21 exposed to the mating cavity 10 and said connecting legs 22. The terminal module 12 is received in the main body 11. The sealing member 3 seals the gap between the terminal module 12 and the main body 11. In a preferred embodiment, the terminal module 12 and the main body 11 have coating areas to provide convenient for combining the sealing member 3 stability.

Figure 3:
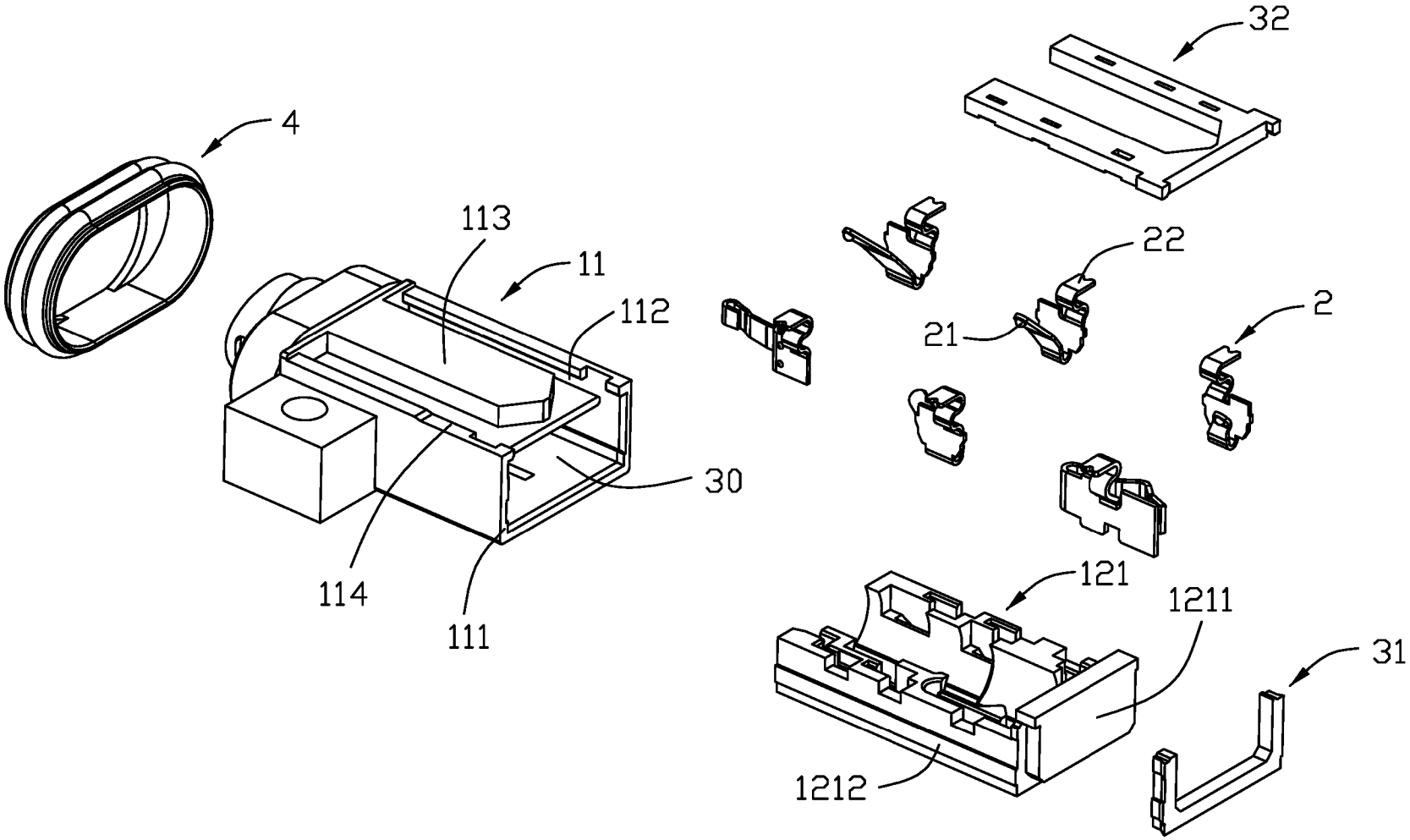
FIG. 3 is an exploded perspective view of the electrical connector shown in FIG. 1.
Figure 4:
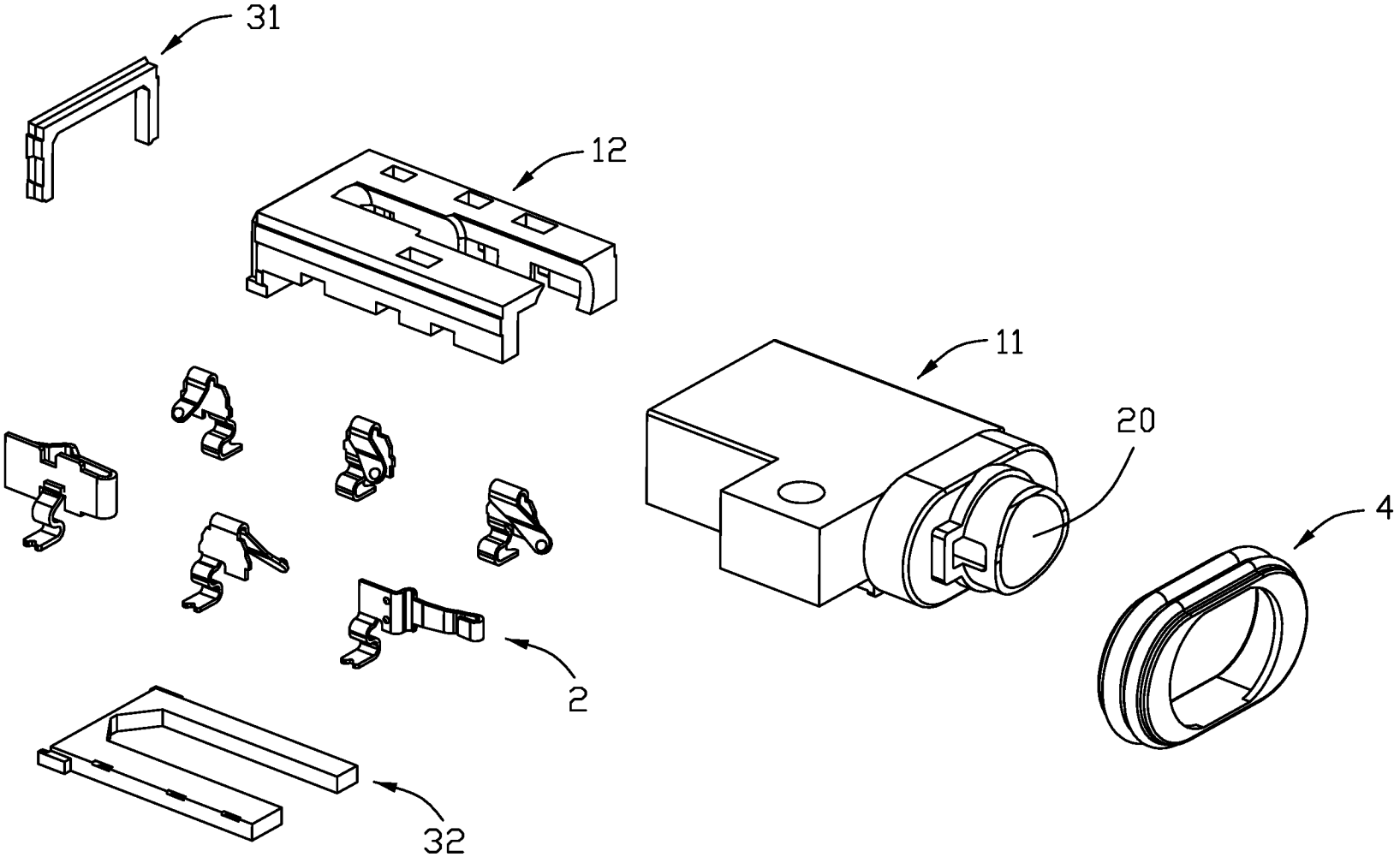
FIG. 4 is another exploded perspective view of the electrical connector shown in FIG. 1.

Referring to FIG. 3 and FIG. 4, the main body 11 has a front opening 20 and a rear opening 30 opposite and communicating with each other via receiving space (not labeled) therebetwween in a front-to-back direction. The front opening 20 is the opening the mating cavity 10 opening forwardly. The terminal module 12 is forwardly assembled into the receiving space of the main body 11 from the rear opening 30. Of course, in other embodiments, the front opening 20 of the main body 11 may be not the opening the mating cavity 10 opening forwardly. Such as, the terminal module 12 may form an opening in a front side forwardly protruding out of the front side of the main body 11 to used as the opening the mating cavity 10 opening forwardly. Combined with FIG. 6, the main body 11 has a mounting face (not labeled) having two assembling slots 112 running rearwardly through a rear face 111 of the main body 11. The connecting legs 22 of the conductive terminals 2 forwardly move along the assembling slots 112 when the terminal module 12 is assembled into the main body 11. The main body 11 has a supporting portion 113 extending rearwardly. The two assembling slots 112 are respectively disposed at two sides of the supporting portion 113. The supporting portion 113 has a second sealing area 132 adjacent to the assembling slot 112. The sealing material is filled in the second sealing area 132 to form a second sealing member 32. In the present invention, the supporting portion 111 has a second protruding portion 131 protruding upwardly to form a groove structure between the second protruding portion 131 and the main body 11. The groove structure is just the second sealing area 132. The main body 11 further has two ribs 114 respectively disposed at two sides of the supporting portion 113 and extending along a front-to-back direction and protruding into the assembling slot 112. The supporting portion 113 and the rib 114 are disposed at two sides of the assembling slot 112.

Figure 5:
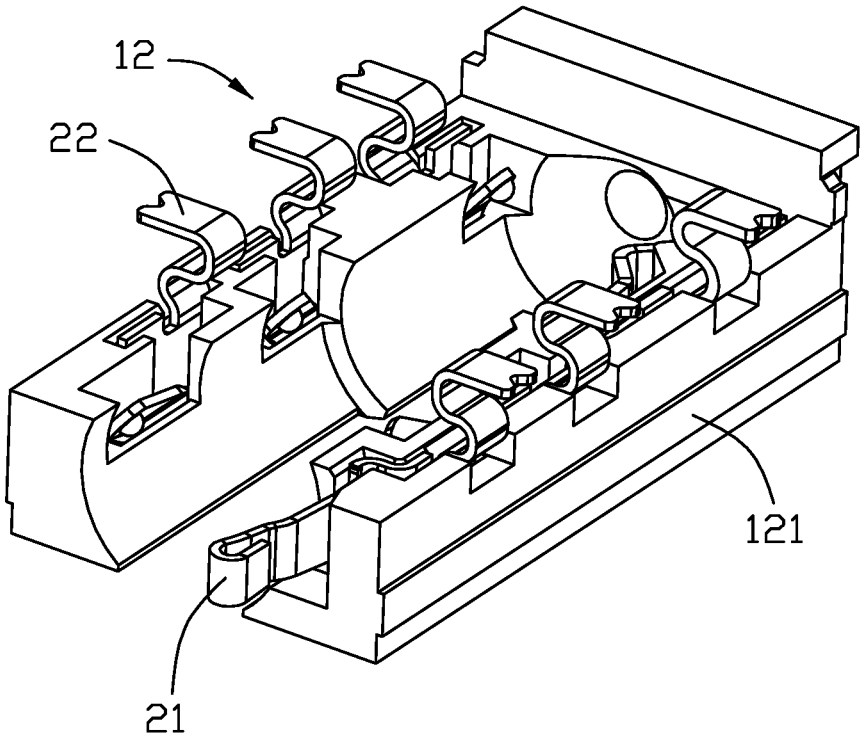
FIG. 5 is a perspective view of a terminal module of the electrical connector shown in FIG. 1.

Referring to FIG. 3 and FIG. 5, the terminal module 12 has an insulator 121 and said conductive terminals 2 received in the insulator 121. The insulator 121 has a rear cover 1211 and two opposite assembling arms 1212 extending forwardly from the rear cover 1211. The plurality of conductive terminals 2 are retained in the assembling arm 1212 one by one along the front to back direction. The connecting legs 22 in a same assembling arm 1212 extend in a same side so as to be convenient for forwardly assembling along the assembling slot 112. In the present invention, the connecting legs 22 all extend outwardly along a transverse direction perpendicular to the front-to-back direction. Combined with FIG. 6, the rear cover 1211 has a first sealing area 1213 adjacent to the main body 11. The sealing material is filled in the first sealing area 1213 to form a first sealing member 31. The rear cover 1211 has a first protruding portion 1214 protruding rearwardly so as to form a groove structure between the first protruding portion 1214 and the main body 11. The groove structure is just the first sealing area 1213. That is to say, the first sealing area 1213 and the second sealing area 132 are just the coating areas of the present invention. The first sealing area 1213 and the second sealing area 132 are both disposed as groove structure to provide convenient for filling the sealing material. The sealing member 3 has a first sealing member 31 and a second sealing member 32 in the embodiment of the invention.

Figure 6:
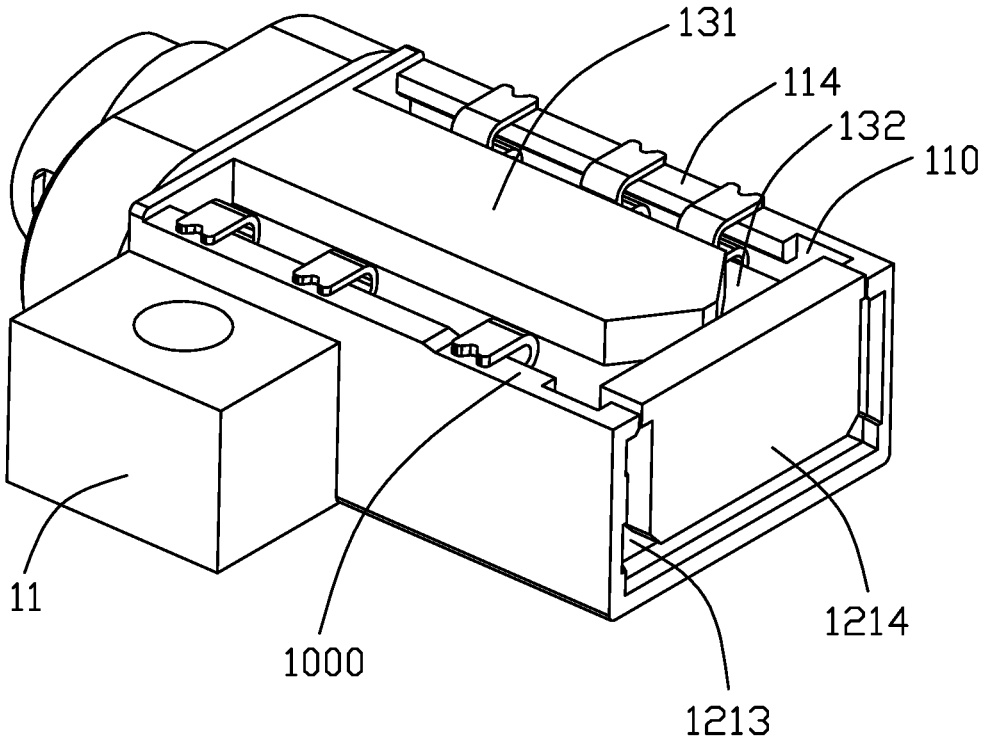
FIG. 6 is a perspective view of the electrical connector shown in FIG. 1, wherein the glue is removed.
Figure 6A:
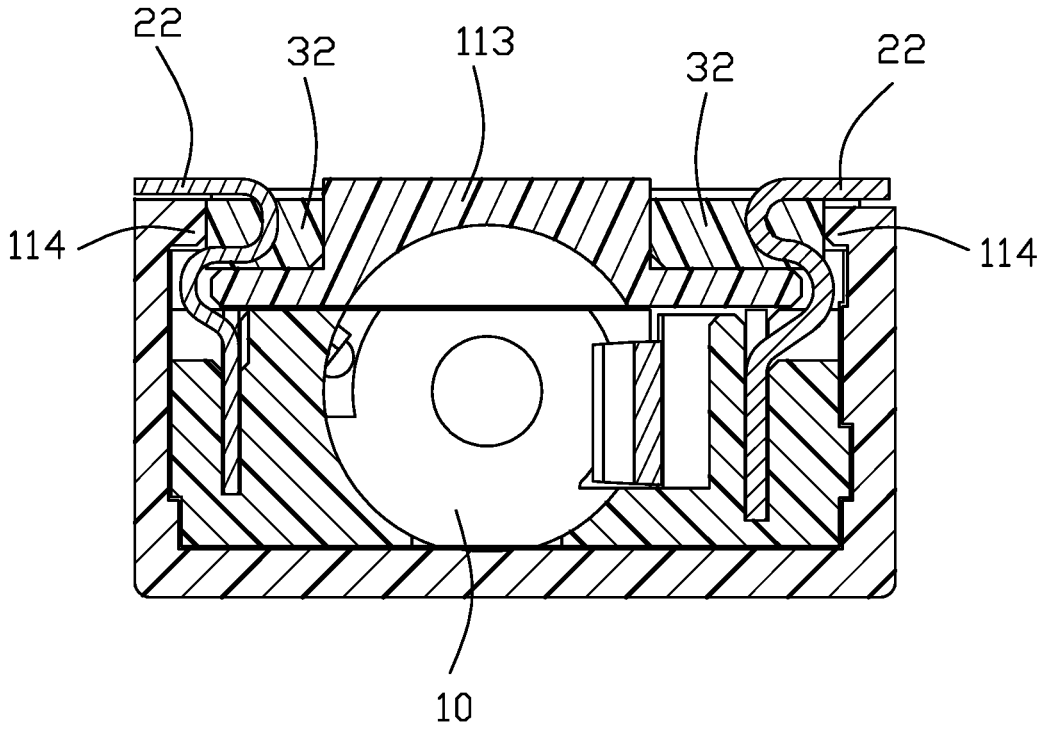
FIG. 6(A) is a cross-sectional view of the electrical connector in a vertical plane taken in FIG. 2.

Referring to FIG. 2 and FIG. 6, the terminal module 12 is assembled into the main body 11 from a rear-to-front direction. The terminal module 12 and the main body 11 are together to form the mating cavity 10. At last, filling the sealing material to the coating areas of the terminal module 12 and the main body 11. In the preferred embodiment, the rib 114 of the main body 11 has a notch 110 located adjacent to the rear cover 1211 and running upwardly and downwardly thereof and communicating with the assembling slot 112. The notch 110 is benefit for filling the sealing material 3 into the gap between the main body 11 and the terminal module 12.

Figure 7:
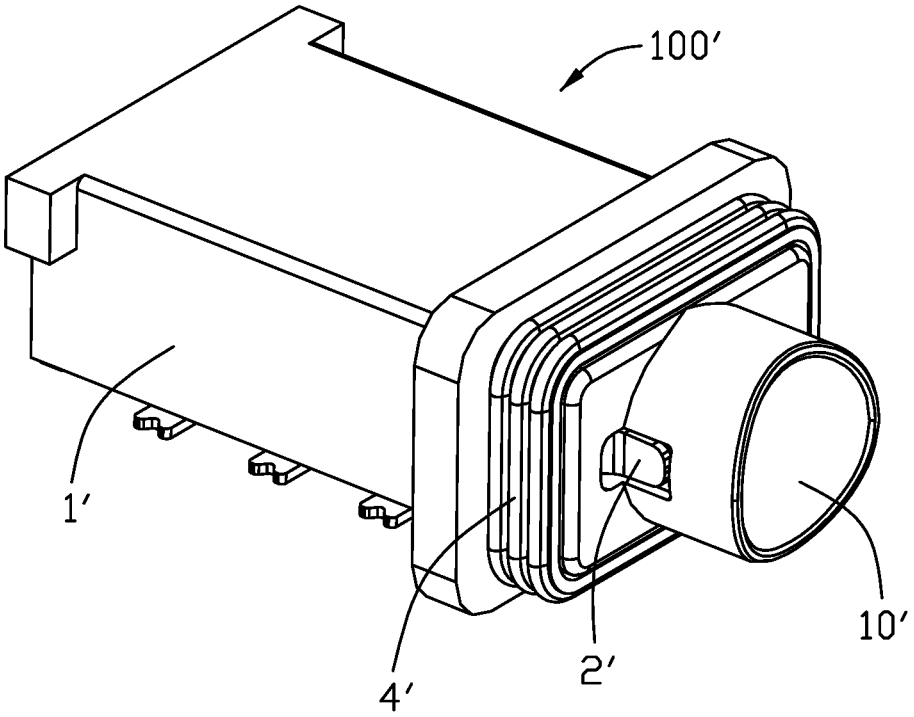
FIG. 7 is a perspective view of an electrical connector of a second embodiment of the present invention.
Figure 8:
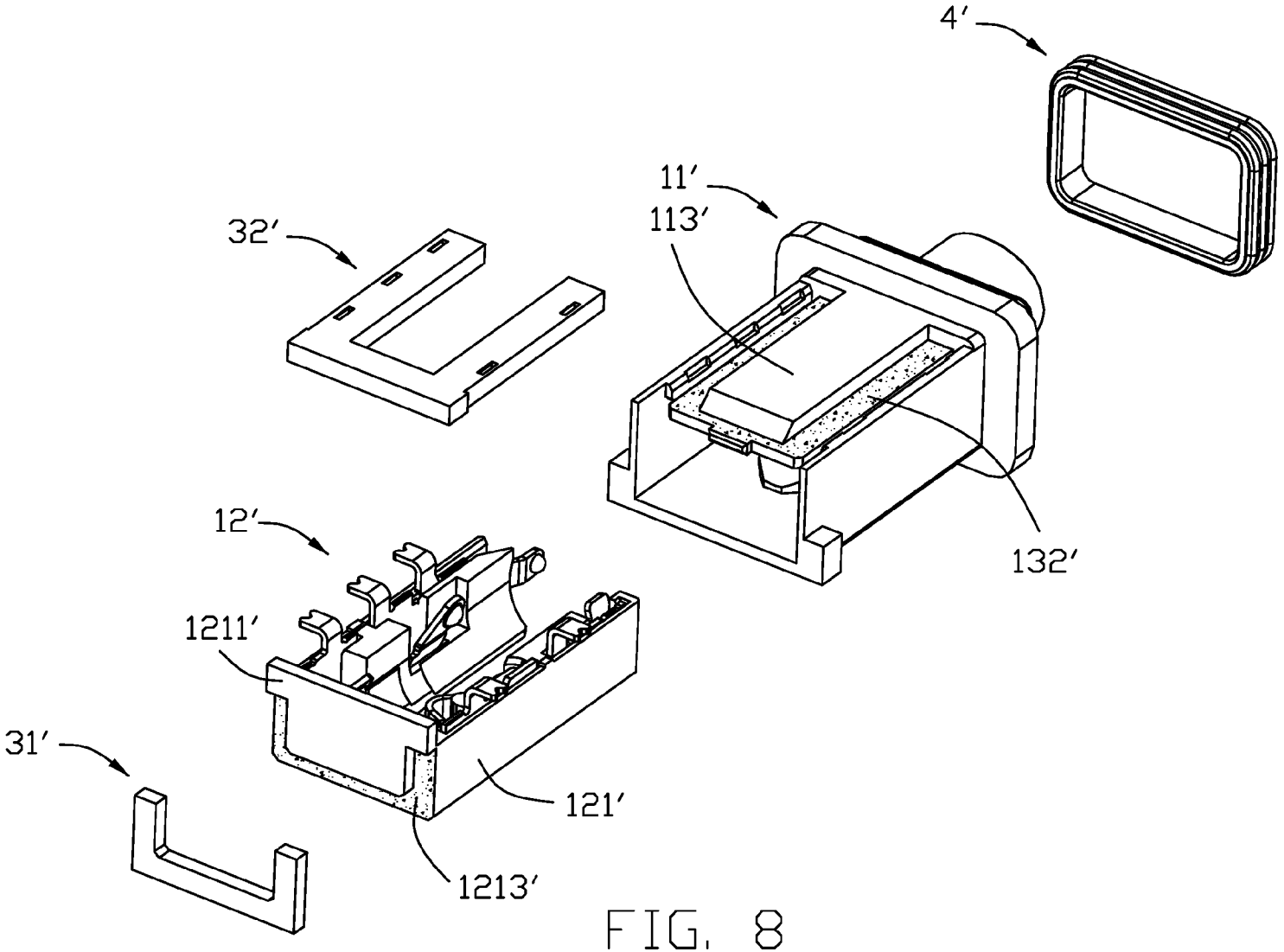
FIG. 8 is an exploded perspective view of the electrical connector shown in FIG. 7.

Referring to FIG. 7 and FIG. 8, an electrical connector 100' of a second embodiment of the present invention is provided. The structure of the electrical connector 100' is rough the same as that of the electrical connector 100 described in the first embodiment. Notably, the same structure will not be described in detail in the present embodiment, the differences will be mainly described in detail hereinafter.

The electrical connector 100' has a mating cavity 10' opening forwardly and comprises an insulating housing 1', a plurality of conductive terminals 2', a sealing member 3 and an O-ring member 4' surrounding an outer surface of a front side of the insulating housing 1'. The O-ring member 4' is made of elastic material such as rubber. The insulating housing 1' has a coating area configured as rough structure and provided for filling sealing material to form the sealing member to seal the gap. In the present embodiment, the insulating housing 1' has a main body 11' and a terminal module 12' assembled into the main body 11' from a rear-to-front direction. The conductive terminals 2' have connecting legs 22' extending out of the insulating housing F. The main body 11' has a first sealing area 132' disposed in a periphery of the connecting legs 22'. The terminal module 12' has a rear cover 1211' having a second sealing area 1213' adjacent to the main body 11'. In the present embodiment, the first sealing area 132' and the second sealing area 1213' are just the coating area. The coating area 132', 1213' are configured as a rough surface to enhance the combination between the sealing member 3' and the main body 11' and the terminal module 12', thereby the waterproof function is further enhanced. Specifically, the sealing member 3' will be not easy to separate from the main body 11' and the terminal module 12' when encountering with a high temperature. The rough surface is also benefit for preventing liquid material outside flowing into an electronic device as a result of the lengthening of the flowing trace. Many ways may be provided for making the rough surface. In the present invention, applicant use electric discharging technology onto a corresponding surface of a die core to make the surface be a rough surface, thereby the insulating housing inset molded by using the die core forms a rough surface which is just the coating area 132', 1213'. In general, the electric discharging technology is also used to a die which needs high precision.

The manufacture of the electrical connector 100' will be described hereinafter. A method of making an electrical connector comprising the following steps: the first step, providing a die having a die core with a coating area; the second step, using electric discharging technology onto the coating area of the die core to form a rough surface; the third step, injecting injection material into the die cavity of the die; the fourth step, dropping the die out after cooling to form a housing, the housing has a coating area configured as a rough surface; the fifth, providing at least a conductive terminal, the conductive terminal is assembled into the housing; the sixth, liquid sealing material is filled in the coating area, the liquid sealing material is dealt by solidification treatment technique to form a solidified sealing material to seal the gap between the housing and the conductive terminal. The solidification treatment technique may be a kind of bake technology. In the present invention, the housing has a main body 11' and an insulator 121', the insulator 121' is insert molded initially and then the conductive terminal 2' is assembled into the insulator 121'. The coating area 132', 1213' is located adjacent to the gap between the conductive terminal 2', the insulator 121' and the main body 11' after the terminal module 12 is assembled into the main body 11. The sealing material 3 is solidified to form the first sealing member 31' and the second sealing member 32'. Of course, the coating area is not limited to disposed in a specific position like that of the present invention. The position to dispose the coating area mainly depends on different structures. What's more, the conductive terminal 2 and the insulator 121' also can be combined by inset molding technology. The housing also may be manufactured as one piece, the coating area is formed in a neighbor of the terminals.

In conclusion, the electrical connector 100, 100' has excellent waterproof function, and the conductive terminal 2, 2' is convenient to be assembled.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector having a mating cavity opening forwardly, comprising:

a main body;

a terminal module having an insulator and a plurality of conductive terminals received therein, the conductive terminals having contacting portions exposed into the mating cavity and connecting legs; and a sealing member;

wherein the terminal module is received in the main body, the sealing member is filled into a gap between the terminal module and the main body to seal the gap;

wherein one of the terminal module and the main body has a coating area configured as a rough surface, the sealing member is formed by filling sealing material to the coating area;

wherein the coating area is formed after dropping out a corresponding die core dealt by electric discharging technology;

wherein the electrical connector is an audio jack connector.

2. The electrical connector as claimed in claim 1, wherein the main body has a rear opening for the terminal module being forwardly assembled into the main body.

3. The electrical connector as claimed in claim 2, wherein the main body has a front opening opposite to and communicating with the rear opening, and the terminal module and the main body cooperate to form the mating cavity.

4. The electrical connector as claimed in claim 1, wherein the insulator has an assembling arm extending forwardly, the conductive terminals are retained in the assembling arm one by one along a front-to-back direction, the connecting legs extend in a same side, the main body has a mounting face having an assembling slot rearwardly going through a rear face of the main body, the connecting legs are forwardly assembled into the main body along the assembling slot.

5. The electrical connector as claimed in claim 4, wherein the insulator has a rear cover, the assembling arm extends forwardly from the rear cover, the rear cover has a first sealing area adjacent to the main body, and the sealing member has a first sealing member formed in the first sealing area.

6. The electrical connector as claimed in claim 4, wherein the main body has a supporting portion extending rearwardly, the assembling slot is disposed at a lateral side of the supporting portion, the supporting portion has a second sealing area adjacent to the assembling slot, and the sealing member has a second sealing member formed in the second sealing area.

7. The electrical connector as claimed in claim 6, wherein the main body has a rib protruding into the assembling slot and extending along the front-to-back direction, the rib has a notch upwardly and downwardly going through thereof and located adjacent to the rear cover and communicating with the assembling slot.

8. A method of making an audio jack electrical connector comprising the following steps:

providing a die having a die core with a coating area;

using electric discharging technology onto the coating area of the die core to form a rough surface;

injecting injection material into the die cavity of the die;

dropping the die after cooling to form a housing, the housing having a coating area configured as a rough surface;

providing at least a conductive terminal to be assembled into the insulating housing;

providing a liquid sealing material to be filled in the coating area, the liquid sealing material being dealt by solidification treatment technique to form a solidified sealing material to seal the gap between the housing and the conductive terminal.

9. The method as claimed in claim 8, wherein the solidification treatment technique may be a kind of bake technology.

10. The method as claimed in claim 8, wherein the housing includes a main body forming a pair of assembling slots along a front-to-back direction to receive the conductive terminals therein, and the conductive terminals are associated within insulator as a terminal module which is forwardly inserted into a receiving space of the main body along the front-to-back direction via a rear opening of the main body.

11. An electrical connector comprising:

an insulative main body forming an interior receiving space;

a terminal module inserted into and snugly receiving within the receiving space and including a plurality of terminals assembled within an insulator; and a sealing member applied upon a combination of said main body and the terminal module to seal not only gaps between the main housing and the terminals but a gap between the main housing and the insulator;

wherein said sealing member further seals gaps between the terminals and the insulator;

wherein said main body defines, along a front-to-back direction, a front opening for receiving a mating plug, and a rear opening through which the terminal module is inserted forwardly into the receiving space along the front-to-back direction;

wherein the insulator cooperates with the main body to form a round mating cavity for receiving said mating plug;

wherein said sealing member is applied upon a horizontal surface of the main body where the legs extend therethrough, and another sealing member is applied upon a vertical surface of the main body around the rear opening to seal a gap between the main body and the insulator, said vertical plane being perpendicular to said horizontal plane.

12. The electrical connector as claimed in claim 11, wherein said main body forms a pair of assembling slots extending along the front-to-back direction, through which legs of the terminals are received.

13. The electrical connector as claimed in claim 12, wherein said sealing member fills said pair of assembling slots.

14. The electrical connector as claimed in claim 13, wherein said terminals and said insulator are configured to have the terminals assembled into the main body along a vertical direction perpendicular to said front-to-back direction.

* * * * *